US009737098B2

(12) United States Patent
De La Rotta

(10) Patent No.: US 9,737,098 B2
(45) Date of Patent: Aug. 22, 2017

(54) SELF-DONNING GOWN

(71) Applicant: Jorge Enrique De La Rotta, Parland, FL (US)

(72) Inventor: Jorge Enrique De La Rotta, Parland, FL (US)

( * ) Notice: Subject to any disclaimer, the term of this patent is extended or adjusted under 35 U.S.C. 154(b) by 181 days.

(21) Appl. No.: 14/743,899

(22) Filed: Jun. 18, 2015

(65) Prior Publication Data

US 2016/0366955 A1 Dec. 22, 2016

(51) Int. Cl.
*A41D 13/12* (2006.01)

(52) U.S. Cl.
CPC ..... *A41D 13/129* (2013.01); *A41D 13/1209* (2013.01)

(58) Field of Classification Search
CPC ..... A41D 13/129; A41D 13/1209; A41D 13/1236; A41D 27/10; A41D 2400/42; A41F 17/00
USPC ..... 2/69
See application file for complete search history.

(56) References Cited

U.S. PATENT DOCUMENTS 2,279,761 A * 4/1942 Schatten ..... A41D 27/10 2/93
3,824,625 A * 7/1974 Green ..... A41D 13/1209 2/114
4,171,542 A * 10/1979 Cox ..... A41D 13/1209 2/114
5,033,115 A * 7/1991 Bowling ..... A41D 13/11 2/48
5,062,158 A * 11/1991 Oka ..... A41B 13/10 2/46
5,184,351 A * 2/1993 Benstock ..... A41D 13/1236 2/105
5,414,867 A * 5/1995 Bowling ..... A41D 13/1209 2/114
5,802,612 A * 9/1998 Hosking ..... A41F 5/00 2/107
5,862,525 A * 1/1999 Tankersley ..... A41D 13/1209 2/105
5,878,437 A * 3/1999 Pater ..... A41D 13/1236 2/114
5,881,382 A * 3/1999 Bernard ..... A41B 13/10 2/48
5,956,763 A * 9/1999 Blackshear ..... A41B 13/106 2/46

(Continued)

*Primary Examiner* — Nathan Durham
*Assistant Examiner* — Anne Kozak
(74) *Attorney, Agent, or Firm* — Ruben ALcoba, Esq.

(57) ABSTRACT

A self-donning nursing gown enables self-donning of a gown while maintaining sterile integrity. The gown provides a pair of shoulder pads having a heavy consistency and grip for gripping the shoulders and maintaining a secure mount on the shoulders. An adhesive panel on a front portion of the gown adheres to the chest area for detachably fastening the gown to the user while the gown is donned. In this manner, the user dons the gown without exposing the hands to a rearward or upwardly disposed non-sterile area, and without assistance from another person. Further, the gown stays on the user without peripheral fastening components. The shoulder pads enable donning of the gown by moving the shoulders in a repetitive up and down motion. The adhesive panel are pressed onto the chest with the sleeves to fasten the gown for use.

12 Claims, 5 Drawing Sheets

(56) References Cited

U.S. PATENT DOCUMENTS

| | | | | |
|---|---|---|---|---|
| 7,549,179 | B1 * | 6/2009 | Saied | A41D 13/0012 2/114 |
| 2005/0132465 | A1 * | 6/2005 | Kathumbi-Jackson | A41D 13/1209 2/114 |
| 2006/0117456 | A1 * | 6/2006 | Griesbach, III | A41D 13/1209 2/114 |
| 2009/0094729 | A1 * | 4/2009 | Lin | A41F 9/025 2/114 |
| 2011/0024485 | A1 * | 2/2011 | Porowski | A41D 13/1209 229/87.16 |
| 2011/0047815 | A1 * | 3/2011 | Asquith | A43B 17/105 36/15 |
| 2011/0154554 | A1 * | 6/2011 | Furlong | A41D 13/1209 2/114 |
| 2011/0247122 | A1 * | 10/2011 | Burke | A41D 13/1245 2/114 |
| 2011/0289644 | A1 * | 12/2011 | Beshlian | A41D 13/1209 2/46 |
| 2015/0150316 | A1 * | 6/2015 | Champagne | A41D 13/1209 2/48 |

* cited by examiner

SELF-DONNING GOWN

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The present invention is directed to a self-donning nursing gown that enables self-donning of a gown while maintaining sterile integrity. The gown provides a pair of shoulder pads having a heavy consistency and grip for gripping the shoulders and maintaining a secure mount on the shoulders. An adhesive panel on a front portion of the gown adheres to the chest area for detachably fastening the gown to the user while the gown is donned.

It is known that surgical gowns are utilized by health care professionals to protect themselves from exposure to fluids and micro-organisms during a surgical procedure. The surgical gown also minimizes contamination of the patient by the health care professional. As such, the health care professionals must keep their hands and arms within a sterile field. The traditional sterile field is the ventral side of the health care professional from approximately the chest or nipple line to the waist. The traditional sterile field also encompasses the area from approximately the elbows to the fingertips.

The inventor is a medical surgeon with fifteen years' experience who understands and appreciates the importance of maintaining a sterile environment in the operating room. A sterile surgical environment is of paramount importance in order to limit the possibility of infection and other complications; for this reason, surgeons have long since worn traditional surgical gowns and limited the number persons in the operation room when performing operations on patients.

The traditional surgical gown is sterile, delivered in a sterilized package, and requires the assistance of another in order for the wearer to don the gown. This is so because the traditional surgical gown has an opening in the back of the gown that can only be closed from behind. As the back of the gown is outside the region typically referred to as the "sterile zone" the wearer of the gown cannot reach behind to close the gown without the assistance of others as doing so would require the wearer to reach behind and place her hands in a non-sterile environment thereby defeating the purpose of wearing a sterilized gown in the first place.

The inventor recognized that there was a great disadvantage of using a traditional surgical gown is that an additional person is needed to don the gown, this not only crowds an already congested area, but it requires the person donning the gown to use precious time that could be directed to the patient's needs.

The inventor also realized that when a medical professional was donning a gown alone, the hands and arms often became exposed to non-sterile fields, such as fasteners, rear areas of the gown, and the head.

Through additional research, the inventor learned that a heavy, grip material could be used to secure the inside surface of the gown to the shoulders and arms of a user. The advantage was increased when the inventor experimented and saw that the gown could be wiggled and shrugged into alignment with the shoulders and body by moving the shoulders in an up and down motion.

However, the inventor saw that once the gown was fully donned, it still had a tendency to slip off the user. The inventor experimented with adhesives and learned that an adhesive panel could be attached to the inner surface of the chest area of the gown. The user could then merely use the outer sleeve surface of the gown to press the adhesive panel against the chest area, and thereby secure the gown onto the user. A cellophane cover could overlay the adhesive panel until it was ready to be fastened to the chest area.

For the foregoing reasons, there is a nursing gown used in medical procedures that is self-donning and prevents exposure to a non-sterile field around the gown while donning and using the gown.

Surgical Gowns have been utilized in the past; yet none with the present delivery expediting characteristics of the present invention. See U.S. Pat. Nos. 5,901,376; 5,862,525; and U.S. Patent Application Publication 20050044608.

For the foregoing reasons, there is a self-donning nursing gown that utilizes heavy, gripping shoulder pads that grip onto the shoulders and an adhesive panel that adheres to the chest area for self-donning of a nursing gown to help prevent hand and arm exposure to a non-sterile field while donning the gown.

SUMMARY

The present invention describes a self-donning nursing gown, hereafter, "gown" enables self-donning of a gown, while maintaining sterile integrity in a sterile-field of the gown, and inhibiting exposure to the hands and arms to a non-sterile field behind and above the gown. The self-donning capacity of the gown is possible because of a pair of shoulder pads and an adhesive panel. The pair of shoulder pads comprise a material fabrication having a heavy consistency and grip. In this manner, the shoulder pads are efficacious for gripping the shoulders and maintaining a secure mount on the shoulders while donning the gown. The adhesive panel is configured to be pressed against, and adhered to a chest area that aligns with the adhesive panel. The adhesive panel enables secure fastening of the gown to the user while the gown is donned. In this manner, the user may don the gown without exposing the hands to a non-sterile area and without assistance from another person. Further, the gown stays on the user without peripheral fastening components.

In some embodiments, the shoulder pads enable the user to don the gown by moving the shoulders in a repetitive up and down motion. Because the shoulder pads are fabricated from a heavy, gripping material the shoulder pads are prevented from slipping off the shoulders. In one embodiment, the shoulder pads are fabricated from a nonwoven, fibered panel. Additionally, the adhesive panel may be pressed onto the chest to securely fasten the gown for use. Because the chest forms a large, central area for the user, the gown has a stable surface area on which to fasten. In either case, while moving the shoulders and body to adjust the shoulder pads, and while pressing the adhesive panel against the chest, the hands are generally not used.

Thus, the manipulations of the shoulder to adjust the shoulder pads, and the pressing of the adhesive panel may be achieved without exposing the hands of the user to a non-sterile field located approximately behind and above the user. Rather, the hands can remain in a sterile field located approximately in front of the user while self-donning the garment. This effectively allows the user to self-don the gown without contaminating the hands by losing sight of them or touching an unseen region of the gown. In this manner, the user may don the gown without the assistance of another person while ensuring that the sterility of the gown or that the hands of the user are not compromised during the donning process.

The gown may be fabricated from a sterile, non-woven, plastic gown worn by a medical professional while engaging a patient. The gown generally conforms to the shape of the user, and is disposable. In one possible embodiment, the gown takes the form of a nursing gown similar to those worn by nurses, surgeons, veterinarians, and medical professionals in general.

In some embodiments, the gown may include a front portion, a back portion, a top opening, a bottom opening, and a pair of sleeves. The front portion of the gown orients towards the forward direction of the user, extending from the top opening (neck) to the bottom opening (feet) of the user. Those skilled in the art will recognize that the forward area of the user body is a non-sterile field and the gown of the present invention is used to cover the non-sterile filed.

The front portion is closed, and has a front inner side and a front outer side. The front inner side is the side of the front portion that engages the user. The front inner side includes the adhesive panel, generally aligned proximal to the chest area of the user. The user may press the adhesive panel against the chest by pressing the front outer side of the front portion against the chest. The adhesive panel may utilize a non-toxic glue that does not stain the clothes of the user. In one embodiment, the glue may be applied on the adhesive panel in a checkerboard pattern. In one possible embodiment, a cover panel, such as cellophane or wax paper, overlays the adhesive panel until the gown is ready for donning. In this manner, the adhesive panel is prevented from adhering to other areas of the gown until donning.

The gown further comprises a back portion that forms the opposite side to the front portion. The back portion orients towards the rear of the user, and extends from the top opening to the bottom opening of the user. The back portion has a back inner side that engages the user and a back outer side that faces away from the user. Those skilled in the art will recognize that the rear area of the user forms a non-sterile field. This area is not easily visible to the user, and thereby cannot maintain sterile integrity during use of the gown.

The back portion further includes a first edge and a second edge. The first edge and the second edge of the back portion remain separate, such that the back portion remains open and is not touched by the user during donning or use of the gown. There are no perimeter fasteners, such as tie strings or hook and loop fasteners on the back portion to form closure. In this manner, the hands do not have to reach back behind the user to close the back portion, and therefore, the hands remain outside the non-sterile field. Of course, the opened back portion is possible because the shoulder pads and adhesive portion retain the gown in proper and secure position on the user.

The top opening and the bottom opening form at the longitudinal ends of the gown. The top opening enables the neck/head of the user to pass through. The bottom opening enables the legs of the user to pass through. Those skilled in the art will recognize that the area of the user above the top opening forms a non-sterile field. This area is occupied by the head, and thereby hair. Further the area above the head is not easily visible to the user, and thereby the hands cannot maintain sterile integrity when positioned above the top opening of the gown.

The gown further comprises a pair of sleeves that extend from the junction between the front portion and the back portion. The sleeves substantially cover the arms of the user, terminating at a sleeve collar. The sleeves have a sleeve inner side that receive and engage the arms of the user, and a sleeve outer side that remains exposed externally while donning the gown.

As discussed above, the pair shoulder pads are configured in the general shape of a user's shoulders. The shoulder pads are disposed to fasten to the inner sides of at least some areas in the sleeves, the front portion, and the back portion. Thus, when the gown is fully donned, the shoulder pads align with the natural position of the user's shoulders. The shoulder pads are fabricated from a material that is generally heavier than the front portion, the back portion, and the sleeves. The material composition of the shoulder pads also has gripping characteristics, so as to retain the gown in proper alignment with the user's general body structure. It is significant to note that, while donning the gown, the user may have to twist, contort, and jiggle from inside the gown to orient and align the shoulder pads to the desired donning position.

In some embodiments, a periphery of the shoulder pad folds over onto the outer side of the sleeves, front portion, and back portion. This periphery folded configuration provides additional structural integrity and also provides an extra surface area for sewing or fastening the shoulder pads into sections of the front portion and back portion.

As discussed above, the chief novelty of the gown is the adhesive panel that secures the gown against the chest of the user into place, and also the shoulder pads that help align the gown during donning. The adhesive panel and the shoulder pads form a synergy that creates an overall self-donning nursing gown. The shoulder pads are positioned in the front and back inner side such that the user may repetitively shrug the shoulders in an up and down motion to manipulate the shoulder pads over the natural position of the user's shoulders.

Thus, once the shoulder pads are properly aligned with the shoulders, the user may use the sleeve outer side to press the front portion, and thereby the adhesive panel, against the user's chest area. The adhesion created by the adhesion panel securely fastens the gown to the user, despite the back portion being open. In this manner, external fasteners, such as tie-strings are not needed. And more importantly, through both manipulations, the user is not exposing the hands above the neck or behind the user's body. This maintains the hands in the sterile field, in front of the user.

Of course, for the adhesive panel and the shoulder pads to be utilized, the gown must be donned using a specific method for self-donning the gown. The method may include an initial Step of providing a gown in a folded configuration. The gown is folded into a compact configuration that maintains the sterility of the gown, while also exposing a pair of openings from the sleeves. This minimizes contact with the hands, so as to maintain the sterile field.

A further Step comprises orienting the sterile folded gown, such that a front portion of the gown faces away from the user's body and the inner side of the gown faces the user's body. The method may also include a Step of placing one hand in a first sleeve and the other hand in a second sleeve of the gown. Another Step comprises of simultaneously inserting the arms through the pair of openings in the sleeves of the gown and thereby unfolding the gown.

Another Step involves moving the shoulders in an up and down motion until the natural position of the shoulders at least partially align with a pair of shoulder pads. While donning the gown, the user may have to twist, contort, and jiggle from inside the gown to orient and align the shoulder pads to the desired donning position on the shoulders and chest area, wherein the hands do not engage the sterile field while during movement of the shoulders in an up and down motion. A final Step includes pressing an adhesive panel on a front inner side of the front portion against the chest, wherein the hands do not engage the non-sterile field while pressing the adhesive panel.

One objective of the present invention is to don a nursing gown while maintaining the hands in a sterile field, and avoiding contact with a non-sterile field.

Another objective of the present invention is to provide a durable, sterile nursing gown that can be donned, used, and removed by a single person.

Another objective of the present invention is to provide a nursing gown that does not have tie-strings, hook and loop fasteners, buttons, or cinch strings to securely fasten to the user.

Yet another objective of the present invention is to provide an adhesive panel that detachably adheres to the chest area of a user, so as to secure the gown on the user.

Yet another objective is to provide shoulder pads inside the gown that conform to the size and shape of shoulders.

Yet another objective is to fabricate the shoulder pads with a heavy, grip material.

Yet another objective is to provide a disposable nurse gown.

Yet another objective is to provide an inexpensive to manufacture nurse gown that is easy to don.

DRAWINGS

These and other features, aspects, and advantages of the present invention will become better understood with regard to the following description, appended claims, and drawings where:

DESCRIPTION

The present invention, referenced in FIGS. 1-5, is directed to a self-donning nursing gown 100, hereafter, "gown 100" and method 200 for donning the gown 100 that enables self-donning of the gown 100, while maintaining sterile integrity in a sterile-field outside of the gown 100, and inhibiting exposure to the hands and arms to a non-sterile field behind and above the gown 100. The gown 100 is configured to be worn in a medical environments and non-medical environments in which care takers that need to maintain sterility. The gown of the present invention 100 may be donned by its user without the aid of others.

Those skilled in the art will recognize that the gown 100 may be utilized by a medical professional to protect from exposure to fluids and micro-organisms during a medical procedure. The gown 100 also minimizes contamination of the patient by the medical professional. As such, the medical professional must keep the hands and arms within a sterile field.

The dangers of exposing the hands and arms to a non-sterile filed are especially pronounced when a single person is donning the gown 100. The single person may have to expose the hands to a non-sterile field while donning, fastening, or adjusting the gown 100. The present invention eliminates this need by utilizing a unique pair of shoulder pads 140*a-b* that enable donning and adjustment without use of the hands. Further, an adhesive panel 138 on the inside of the gown 100 enables a user to adhere the gown 100 to the chest area with the sleeves 130*a-b*.

Those skilled in the art, in light of the present teachings, will recognize that the term "sterile field" is generally understood by those in the field to refer to the region generally in front of the user's body beginning substantially near to the user's neckline and extending substantially to the user's waist line. The sterile field is also generally understood to extend laterally outward to the sides of the wearer's body. Conversely, the term "non-sterile field" refers to the region approximately above the head, and behind the user. The sterile fields of the gown are considered to lie between the chest and the waist of the gown and the arms of the gown when worn by the user.

In some embodiments, the gown 100 enables facilitated donning without exposing the hands to a non-sterile area and without assistance from another person. Further, the gown 100 stays on the user without peripheral fastening components. Thus, tie-strings, hook and loop fasteners, buttons, or cinch strings are not needed to securely fasten the gown 100 to the user. This reduces the possible points of contamination, or non-sterile field on the gown 100.

Figure 1:
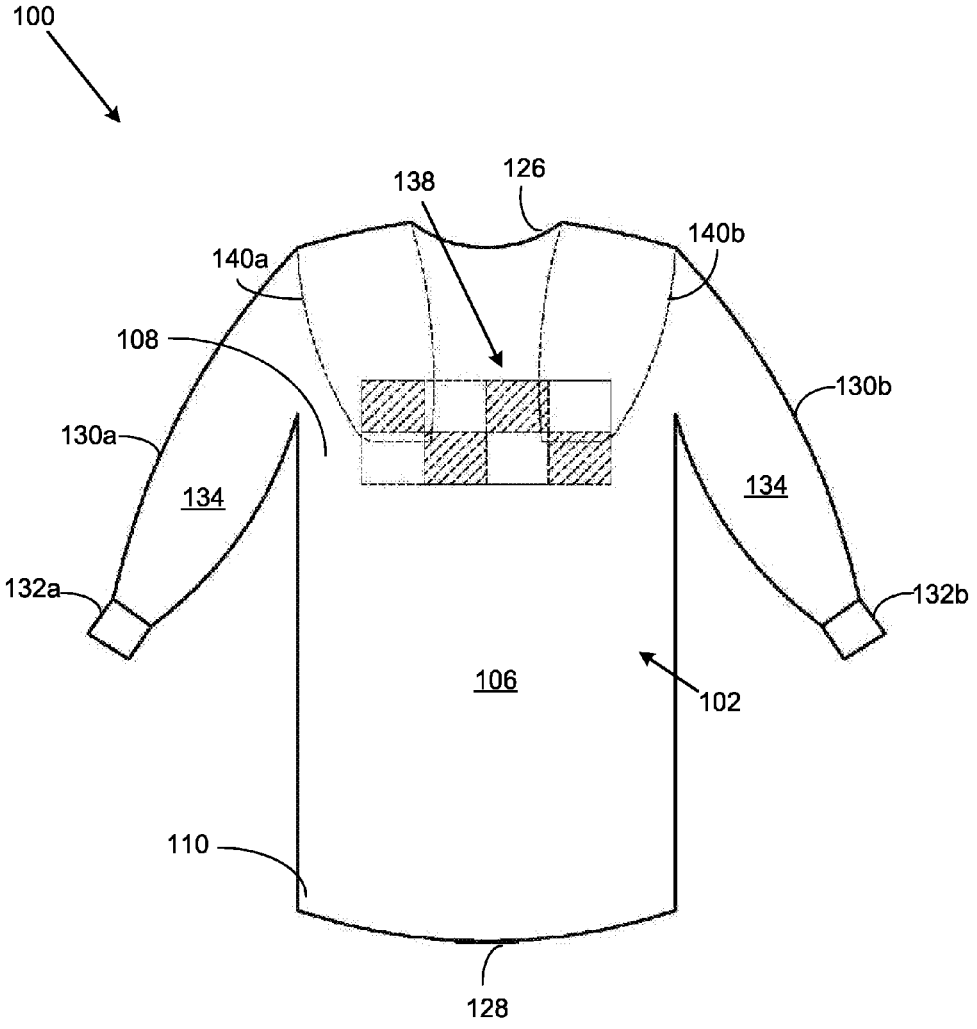
FIG. 1 is a front perspective view of an exemplary self-donning nursing gown, showing a sectioned view of an exemplary adhesive panel, in accordance with an embodiment of the present invention.

As shown in the frontal view of FIG. 1, the gown 100 provides a pair of shoulder pads 140*a-b* having a heavy consistency and grip for gripping the shoulders and maintaining a secure mount on the shoulders while donning the gown 100. The gown 100 further provides an adhesive panel 138 that adheres to the chest area for detachably fastening the gown 100 to the user while the gown 100 is donned.

In some embodiments, the shoulder pads 140*a-b* enable the user to don the gown 100 by moving the shoulders in a repetitive up and down motion. Because the shoulder pads 140*a-b* are fabricated from a heavy, gripping material the shoulder pads 140*a-b* are prevented from slipping off the shoulders. In one embodiment, the shoulder pads 140*a-b* are fabricated from a nonwoven, fibered panel.

Additionally, the adhesive panel 138 may be pressed onto the chest to securely fasten the gown 100 for use. Because the chest forms a large, central area for the user, the gown 100 has a stable surface area on which to fasten. In either case, while moving the shoulders and body to adjust the shoulder pads 140*a-b*, and while pressing the adhesive panel 138 against the chest, the hands are generally not used.

Thus, the manipulations of the shoulder to adjust the shoulder pads 140*a-b*, and the pressing of the adhesive panel 138 may be achieved without exposing the hands of the user to a non-sterile field located approximately behind and above the user. Rather, the hands can remain in a sterile field located approximately in front of the user while self-donning the garment. This effectively allows the user to self-don the gown 100 without contaminating the hands by losing sight of them or touching an unseen region of the gown 100. In this manner, the user may don the gown 100 without the assistance of another person while ensuring that the sterility of the gown 100 or that the hands of the user are not compromised during the donning process.

The gown 100 may be fabricated from a sterile, plastic gown 100 worn by a medical professional while engaging a patient. Though, in other embodiments, the gown 100 may be fabricated from a single continuous sheet of paper-like or cotton-like material or alternatively the gown 100 body may be composed of a plurality of sheets of material, whereby each sheet of material is sewn together or attached by other means known in the art. The gown 100 generally conforms to the shape of the user, and is disposable. In one possible embodiment, the gown 100 takes the form of a nursing gown 100, as those worn by nurses, surgeons, veterinarians, and medical professionals in general.

Looking at FIG. 1, the gown 100 may include a front portion 102, a back portion 112, a top opening 126, a bottom opening 128, and a pair of sleeves 130*a-b*. The front portion 102 of the gown 100 orients towards the forward direction of the user, extending from the top opening 126 (neck) to the bottom opening 128 (feet) of the user. The front portion 102 is closed, and has a front inner side 104, a front outer side 106, a front top area 108, and a front bottom area 110.

The front inner side 104 is the side of the front portion 102 that engages the user. The front inner side 104 includes the adhesive panel 138, generally aligned proximal to the chest area of the user. The user may press the adhesive panel 138 against the chest by pressing the front outer side 106 of the front portion 102 against the chest. The adhesive panel 138 may utilize a nontoxic glue that does not stain.

In one embodiment, the glue may be applied on the adhesive panel 138 in a checkerboard pattern. In one possible embodiment, a cover panel 140*a-b*, such as cellophane, overlays the adhesive panel 138 until the gown 100 is ready for donning. In this manner, the adhesive panel 138 is prevented from adhering to other areas of the gown 100 until donning.

Figure 2:
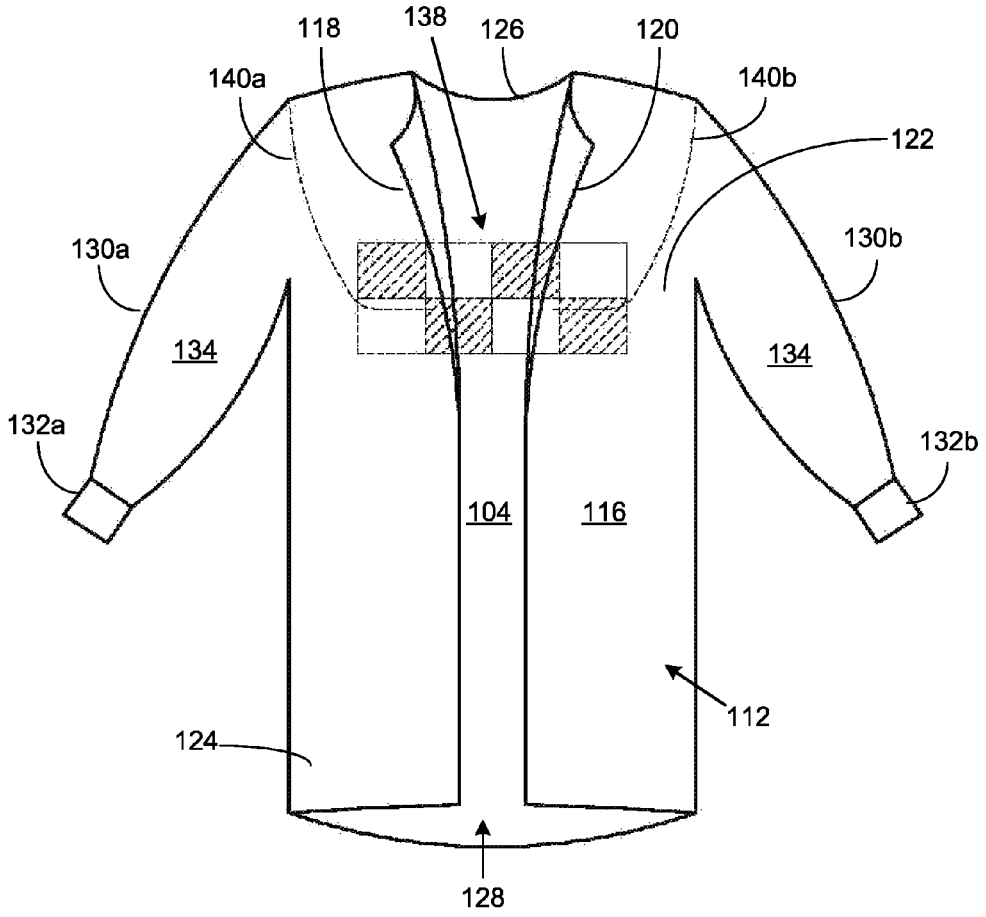
FIG. 2 is a rear perspective view of the self-donning nursing gown, showing the adhesive panel, in accordance with an embodiment of the present invention.

As referenced in FIG. 2, the gown 100 further comprises a back portion 112 that forms the opposite side to the front portion 102. The back portion 112 orients towards the rear of the user, and extends from the top opening 126 to the bottom opening 128 of the user. The back portion 112 has a back inner side 114 that engages the user and a back outer side 116 that faces away from the user. The back portion 112 further comprises a back top area 122 and a back bottom area 124. Those skilled in the art will recognize that the rear area of the user and the inner surface of the gown form the non-sterile field. The sterility of these areas cannot be maintained while donning or operating in the gown 100.

Figure 3:
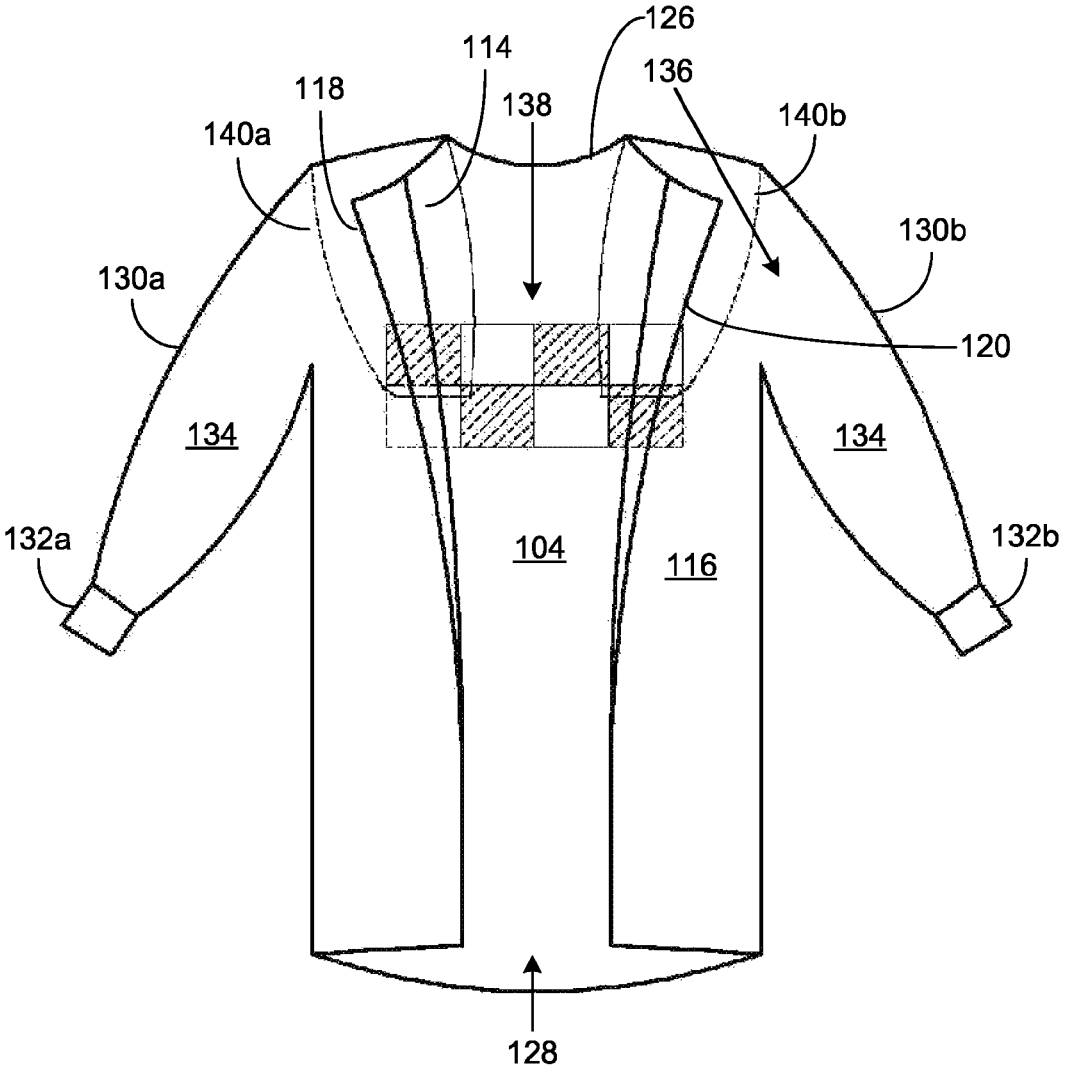
FIG. 3 is a rear perspective view of the self-donning nursing gown, showing an exemplary first edge and second edge of a back portion partially open, in accordance with an embodiment of the present invention.

As shown in FIG. 3, the back portion 112 further includes a first edge 118 and a second edge 120. The first edge 118 and the second edge 120 of the back portion 112 remain separate, such that the back portion 112 remains open and is not touched by the user during donning or use of the gown 100. There are no perimeter fasteners, such as tie strings or hook and loop fasteners on the back portion 112 to form closure. In this manner, the hands do not have to reach back behind the user to close the back portion 112, and therefore, the hands remain outside the non-sterile field. Of course, the opened back portion 112 is possible because the shoulder pads 140*a-b* and adhesive portion retain the gown 100 in proper and secure position on the user.

The top opening 126 and the bottom opening 128 form at the longitudinal ends of the gown 100. The top opening 126 may be disposed at the junction between the front top area 108 and the back top area 122. The top opening 126 is sized and dimensioned to enable the neck/head of the user to pass through.

The bottom opening 128 may be disposed at the junction between the front bottom area 110 and the back bottom area 124. The bottom opening 128 is sized and dimensioned to enable the legs of the user to pass through. Those skilled in the art will recognize that the region above the top opening 126 forms a non-sterile field. This region is occupied by the head, and thereby hair, which is known to carry contaminants. Further the region above the head is not easily visible to the user, and thereby the hands cannot maintain sterile integrity when positioned above the top opening 126 of the gown 100.

The gown 100 further comprises a pair of sleeves 130*a-b* that extend from the junction between the front portion 102 and the back portion 112. The sleeves 130*a-b* substantially cover the arms of the user, terminating at a sleeve collar 132*a-b*. The sleeves 130*a-b* have a sleeve inner side that receive and engage the arms of the user, and a sleeve outer side 134 that remains exposed externally while donning the gown 100.

As discussed above, the pair shoulder pads 140*a-b* are configured in the general shape of a user's shoulders. The shoulder pads 140*a-b* are disposed to fasten to the inner sides of at least some areas in the sleeves 130*a-b*, the front portion 102, and the back portion 112. Thus, when the gown 100 is fully donned, the shoulder pads 140*a-b* align with the natural positon of the user's shoulders. The shoulder pads 140*a-b* are fabricated from a material that is generally heavier than the front portion 102, the back portion 112, and the sleeves 130*a-b*.

Further, the material composition of the shoulder pads 140*a-b* also has gripping characteristics, so as to retain the gown 100 in proper alignment with the user's general body structure. It is significant to note that, while donning the gown 100, the user may have to twist, contort, and jiggle from inside the gown 100 to orient and align the shoulder pads 140*a-b* to the desired donning position.

In some embodiments, a periphery 144 of the shoulder pad folds over onto the outer side of the sleeves 130*a-b*, front portion 102, and back portion 112. This peripheral folded configuration provides additional structural integrity and also provides an extra surface area for sewing or fastening the shoulder pads 140*a-b* into sections of the front portion 102 and back portion 112.

Figure 4:
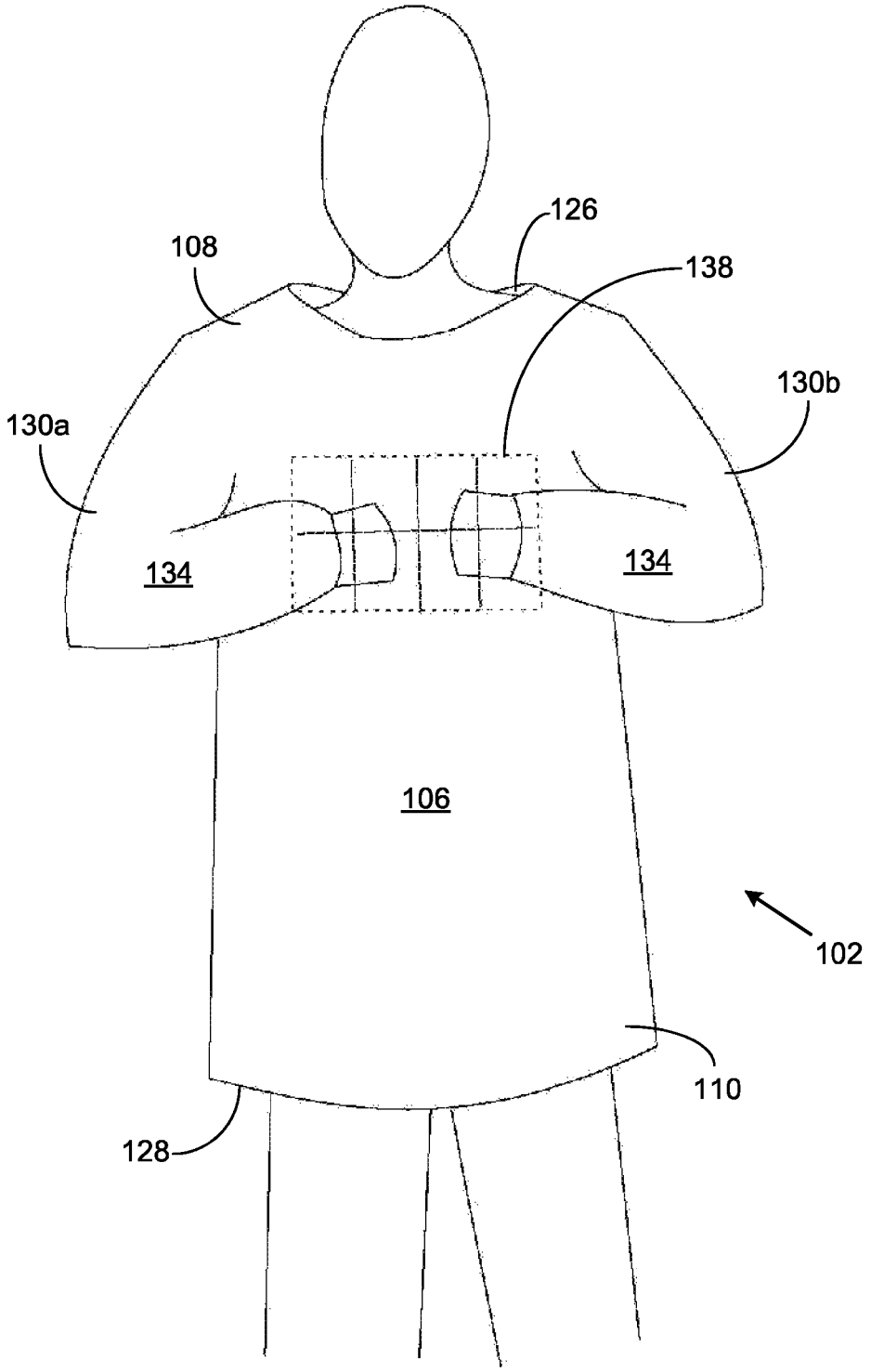
FIG. 4 is a rear perspective view of the self-donning nursing gown being donned by pressing the adhesive panel against a chest area, in accordance with an embodiment of the present invention.

As illustrated in FIG. 4, the chief novelty of the gown 100 is the adhesive panel 138 that secures the gown 100 against the chest of the user into place, and also the shoulder pads 140*a-b* that help align the gown 100 during donning. The adhesive panel 138 and the shoulder pads 140*a-b* form a synergy that creates an overall self-donning nursing gown 100. The shoulder pads 140*a-b* are positioned in the front and back inner side 114 such that the user may repetitively shrug the shoulders in an up and down motion to manipulate the shoulder pads 140*a-b* over the natural positon of the user's shoulders.

Thus, once the shoulder pads 140*a-b* are properly aligned with the shoulders, the user may use the sleeve outer side 134 to press the front portion 102, and thereby the adhesive panel 138, against the user's chest area. The adhesion created by the adhesion panel securely fastens the gown 100 to the user, despite the back portion 112 being open. In this manner, external fasteners, such as tie-strings are not needed. And more importantly, through both manipulations, the user is not exposing the hands above the neck or behind the user's body. This maintains the hands in the sterile field, in front of the user.

Figure 5:
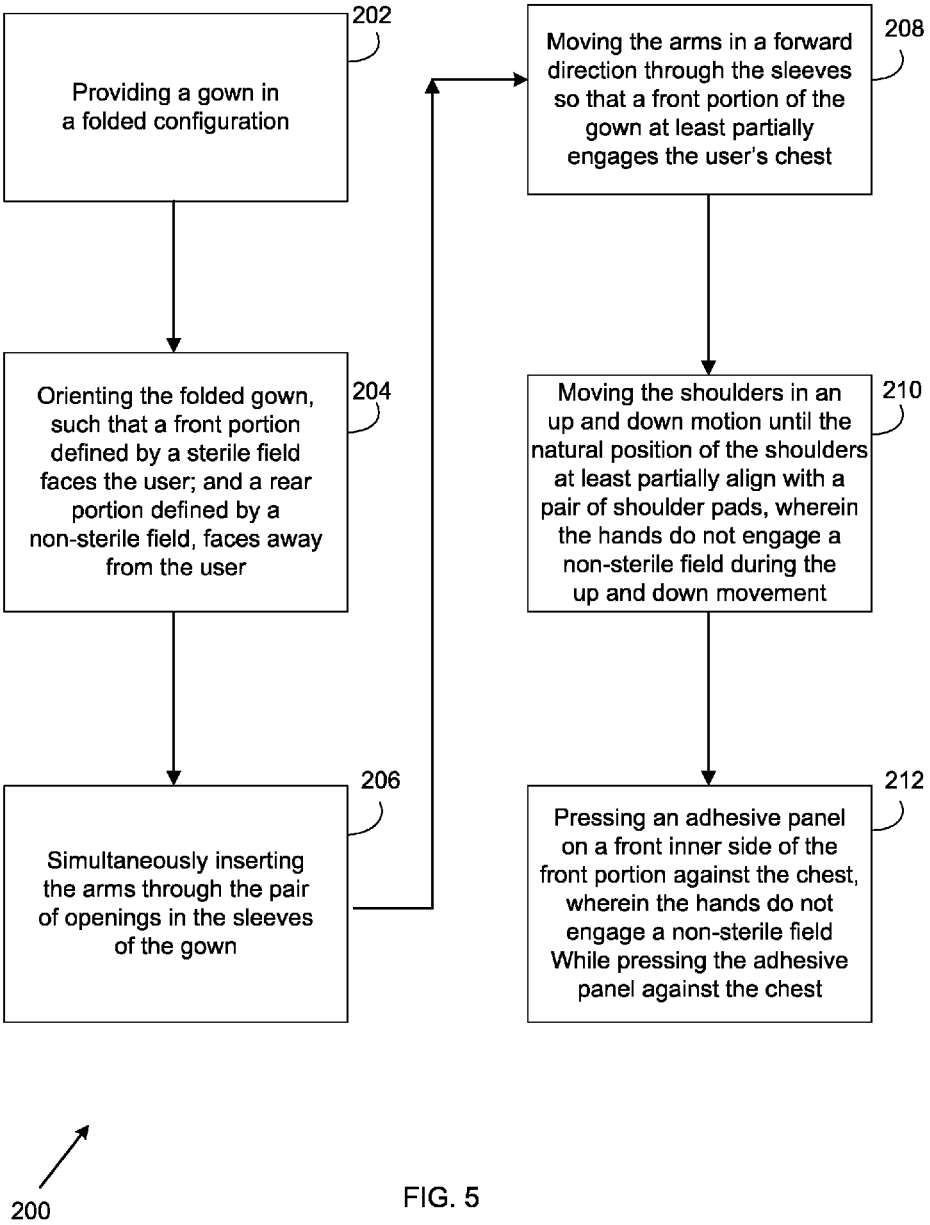
FIG. 5 illustrates a flowchart diagram of an exemplary method for self-donning a nursing gown with a pair of shoulder pads and an adhesive panel, in accordance with an embodiment of the present invention.

FIG. 5 illustrates a flowchart diagram of an exemplary method 200 for self-donning a nursing gown 100 with a pair of shoulder pads 140*a-b* and an adhesive panel 138. The method 200 may include an initial Step 202 of providing a gown 100 in a folded configuration. The gown 100 is folded into a compact configuration that maintains the sterility of the gown 100, while also exposing a pair of openings 136 from the sleeves 130*a-b*. This minimizes contact with the hands, so as to maintain the sterile field. In some embodiments, the gown 100 may include a front portion 102, a back portion 112, a top opening 126, a bottom opening 128, and a pair of sleeves 130*a-b*.

The procedural techniques for folding the gown 100 may include the following: placing the gown 100 on a flat surface with the front portion 102 facing up; forming two triangular folds at the bottom two corners; folding up the bottom third of the gown 100; folding up the gown 100 half way, folding the gown 100 another half fold; forming a lateral pleated fold in half, and then bringing the fold in one quarter fold; flipping the gown 100 over; and folding the gown 100 again laterally. At this point, the gown 100 is in the folded configuration, and a pair of openings 136 in the sleeves 130*a-b* is accessible.

A further Step 204 comprises orienting the folded gown 100, such that a front portion 102 and a rear portion are defined. The method 200 may also include a Step 206 of simultaneously inserting the arms through the pair of openings 136 in the sleeves 130*a-b* of the gown 100.

A Step 208 comprises moving the arms in a forward direction through the sleeves 130*a-b* so that a front portion 102 of the gown 100 at least partially engages the user's chest. Another Step 210 involves moving the shoulders in an up and down motion until the natural position of the shoulders at least partially align with a pair of shoulder pads 140*a-b*. While donning the gown 100, the user may have to twist, contort, and jiggle from inside the gown 100 to orient and align the shoulder pads 140*a-b* to the desired donning position on the shoulders and chest area, wherein the hands do not engage the non-sterile field while during movement of the shoulders in an up and down motion.

A final Step 212 includes pressing an adhesive panel 138 on a front inner side 104 of the front portion 102 against the chest, wherein the hands do not engage the non-sterile field while pressing the adhesive panel 138 (FIG. 4). The front inner side 104 includes the adhesive panel 138, generally aligned proximal to the chest area of the user. The user may press the adhesive panel 138 against the chest by pressing the front outer side 106 of the front portion 102 against the chest. The adhesive panel 138 may utilize a nontoxic and non-staining glue.

While the inventor's above description contains many specificities, these should not be construed as limitations on the scope, but rather as an exemplification of several preferred embodiments thereof. Many other variations are possible. For example, the shoulder pads 140*a-b* may be configured to cover the breast area of a woman to provide additional grip. Accordingly, the scope should be determined not by the embodiments illustrated, but by the appended claims and their legal equivalents.

What is claimed is:

1. A self-donning medical provider gown for enabling self-donning with a pair of shoulder pads and an adhesive panel, the gown comprising: a front portion, the front portion having a front inner side, a front outer side, a front top area, and a front bottom area, the front portion disposed to face in a forward direction, wherein the front portion is sterile;

a back portion, the back portion having a back inner side, a back outer side, a back top area, a back bottom area, a first edge, and a second edge, the back portion disposed to face in a rearward direction, the first edge and the second edge configured to maintain separation;

a pair of sleeves, the pair of sleeves having a sleeve inner side and a sleeve outer side, the pair of sleeves configured to form a pair of openings for enabling passage into the sleeve inner side;

a top opening, the top opening disposed at the front top area and the back top area, the top opening disposed to face in an upward direction;

a bottom opening, the bottom opening disposed at the front bottom area and the back bottom area;

a pair of shoulder pads that are made of a material that is made of a heavier consistency than the front portion, the back portion, and the sleeves, the pair of shoulder pads disposed to cover at least a portion of the front inner side, the back inner side, and the sleeve inner sides, the pair of shoulder pads configured to form a grip while being manipulate in an up and down movement, wherein manipulation of the pair of shoulder pads through the up and down movement helps while self-donning the gown, and wherein manipulation of the pair of shoulder pads through the up and down movement helps prevent engagement with a non-sterile field; and an adhesive panel, the adhesive panel is in a checkerboard pattern and is attached to the front inner side of the front portion so that the adhesive portion is configured to align to the chest area of a user, the adhesive panel configured to form an adhesion, wherein formation of the adhesion helps restrict movement of the donned gown, and wherein the formation of the adhesion helps prevent engagement with the non-sterile field.

2. The medical provider gown of claim 1, wherein the gown is fabricated from a plastic.

3. The medical provider gown of claim 1, wherein the gown is configured to inhibit engagement by a hand from behind the back portion and above the top opening.

4. The medical provider gown of claim 1, wherein the front portion is configured to extend from the head to the ankles.

5. The medical provider gown of claim 1, wherein the back portion is configured to extend from the head to the ankles.

6. The medical provider gown of claim 1, wherein the separation between first edge and the second edge of the back portion maintains the back portion in an open disposition.

7. The medical provider gown of claim 1, wherein the pair of sleeves terminate at a sleeve collar.

8. The medical provider gown of claim 1, wherein the pair of sleeves are configured to enable passage of a pair of arms.

9. The medical provider gown of claim 1, wherein the top opening is configured to enable passage of a head.

10. The medical provider gown of claim 1, wherein the bottom opening is configured to enable passage of the feet.

11. The medical provider gown of claim 1, wherein the adhesive panel is rectangular in shape.

12. The medical provider gown of claim 1, wherein the pair of shoulder pads are configured to be shaped and dimensioned to substantially match the contour of a pair of shoulders.

* * * * *